United States Patent [19]

Naramore

[11] 4,368,972

[45] Jan. 18, 1983

[54] VERY HIGH SPEED DUPLICATOR WITH FINISHING FUNCTION

[75] Inventor: Raymond A. Naramore, Penfield, N.Y.

[73] Assignee: Xerox Corporation, Stamford, Conn.

[21] Appl. No.: 254,343

[22] Filed: Apr. 15, 1981

[51] Int. Cl.[3] ..... G03G 15/00

[52] U.S. Cl. ..... 355/14 SH; 271/292; 355/3 SH; 355/23

[58] Field of Search ..... 355/3 SH, 14 SH, 23, 355/24; 271/294, 297, 292

[56] References Cited

U.S. PATENT DOCUMENTS

| | | | |
|---|---|---|---|
| 3,709,492 | 1/1973 | Baker et al. | 271/64 |
| 3,995,748 | 12/1976 | Looney | 271/294 X |
| 4,134,672 | 1/1979 | Burlew et al. | 355/14 |

OTHER PUBLICATIONS

*IBM Tech. Disc. Bull.,* vol. 18, No. 9, Feb., 1976, p. 2807.
IBM Technical Disclosure Bulletin, vol. 18, No. 10, Mar. 1976, pp. 3160-3161.
Research Disclosure Bulletin, Sep. 1979, pp. 497-499, Paper No. 18541.

*Primary Examiner*—R. L. Moses
*Attorney, Agent, or Firm*—Bernard A. Chiama

[57] ABSTRACT

A collation system is disclosed for use with a very high speed, fully automated reproduction system having a document handling apparatus, copy sheet processor, and a finishing station. In this arrangement, a sorter bin array is arranged to collate the copy sheets into copy sets corresponding to a multiple page document, the array being held stationary for the collection of some of the copy sheets and is moved past a sheet-receiving station for receiving at least one of the copy sheets.

10 Claims, 7 Drawing Figures

PROGRAMER LOGIC AND MICROPROCESSOR
PROCESSOR
XEROGRAPHIC PROCESSING
SHEET FEED
INPUT STATION
FLASH ILLUMINATION
ADH
SWITCHES AND SENSORS S-1, SR-1 SR-2, SR-3 SR-4
DRIVER
ELEVATOR MOTOR M-4
FINISHING STATION
SERVO CONTROL
SORTER GATES
POWER AMP
STAPLER DRIVE
STAPLER CLAMPING
STAPLER CLINCHING
SET TRANSPORT MOTOR M-2
INDEX MOTOR M-1

VERY HIGH SPEED DUPLICATOR WITH FINISHING FUNCTION

This invention relates to an improved finishing station for use in a reproduction system.

With the advent of higher speed and more sophisticated copy producing machines, printing presses, and the like, considerations as to how the mass of copies generated can best and most effectively be handled, has assumed increasing importance. One way has been to provide a reproduction system with an input device in the form of a recirculating document handling apparatus. In this system, a document sheet is removed from a collated set of document sheets, placed on an exposure platen for exposure at the rate of one exposure for each document sheet, and returned to the top of the set in the document handling apparatus until the set of document sheets has been completely circulated through the apparatus, and a copy set has been produced. The set of document sheets is then recycled for the reproduction of a second copy set, and so on. After each copy set is produced and collected at a collection station, a finishing device such as a stitcher is activated to bind the set. These systems are of the pre-collation type wherein the document sheets are precollated in the document handling apparatus prior to commencement of a reproduction run. The output for the reproduction machine will likewise be precollated in sets corresponding to the sequenced numbered document set in the document handling apparatus. The copy sheets are collected in collated sets as they are sequentially produced so that binding may be effected without the interaction of additional devices. Such systems are described in U.S. Pat. No. 4,134,672.

One of the disadvantages in these systems having continuous document recirculation to produce each bound copy set is that for compilation of each copy set and eventual stapling or stitching, many moving parts have been required and have added to the risks of unscheduled maintenance. In addition, generally, in providing for the stapling or stitching step, a varied number of machine pitches per set may be lost thereby reducing throughput for the system.

In order to achieve still higher rates of production of finished copy sets, the present invention contemplates the concept of utilizing post-collation rather than precollation. The inventive arrangement utilizes document handling wherein a predetermined number of light images are produced for each document sheet, say for example, of page one of a multi-page document, before a successive document sheet, perhaps page two of the document, is likewise imaged. This sequencing in turn may be repeated many more times if a very large number of copy sets are to be reproduced. In this manner, the mechanical movements involved in document handling are held to a minimum. As the copy sheets are being produced in accordance with the above imaging procedure, a single array of collecting bins or sorter is held stationary and arranged to receive the copy sheet output for collating the same into collated sets by means of a vertically arranged transport. For at least the last copy sheet of the sets, the array is indexed vertically to receive the last sheet. As the array is being so indexed, each completed set is removed from a bin, and a finishing device such as a stitcher or stapler is positioned and activated to apply a staple to each completed set. This arrangement is different than that disclosed in U.S. patent application Ser. No. 180,184, filed Aug. 21, 1980, and commonly assigned in that the present invention utilizes a stationary sorter while collecting all but at least the last copy sheet and then indexes the sorter to collect the last sheet and to permit removal of the completed sets for stitching or stapling. In the earlier filed, above-referred to application, the sorter is indexed vertically in both directions to collect all copy sheets of a set. With the present arrangement, maximum throughput is available from the various apparatus utilized in the reproduction system; this effort being accomplished with a minimum of moving parts, less wear and tear, less down time or maintenance for the apparatus utilized. In addition, the present arrangement offers a more economical system since sorter indexing noise is lower and there is lower power requirements. More productivity is possible because the last copy sheet is always fed while the sorter is moving downwardly regardless of the number of document sheets thus avoiding wasted down time without this feature.

In the IBM Technical Disclosure Bulletin, Vol. 18, No. 10, March 1976, pages 3160–3161, a collator-stapler mechanism is disclosed as having a single array of collating bins which are held in fixed position while a traveling clamp moves along to pick up a copy set from each bin and to convey the same to a jogger and then a stapler.

The Research Disclosure Bulletin of September 1979, pages 497–499, Paper No. 18541, illustrates and describes a copy system having a document handler 12, a copy processor, copy storage section 14, and a finisher 16. Ordinarily, the section 14 functions in the manner of a stacking device wherein each bin collects all of the copies of a document sheet either manually or in combination with the handler 12 and is not utilized as a collator. However, the system can be programmed so that the section 14 functions as a conventional collator. There is no provision for coordinating or integrating this function with that of a finisher to arrive at high speed continuous collating and finishing.

Present day machines on the market, such as the Xerox duplication machines labeled the 9400 Duplicator and the 9500 Duplicator marketed by Xerox Corporation of Stamford, Conn., utilize a document handler as an input device which exposes as many copies of a single document sheet at a time as is appropriate before starting on the next document sheet. Any other suitable type of automatic document handler may also be used in conjunction with the processor for the 9400 or 9500 Duplicators.

It is therefore the principal object of the present invention to produce bound sets or stacks of copies of a multi-page document at the highest speed possible for a reproduction machine.

It is a further object of the present invention to maintain full productivity in a reproduction/finishing system by eliminating those machine copy cycle pitches which are wasted during some machine operating steps.

It is another object of the present invention to minimize the number of moving parts in a finishing station and to reduce the number of movements usually incurred during the operation thereof.

The present invention is directed to a finishing apparatus for binding copy sheets received in succession at a sheet collecting device, comprising a single bin array, having a series of individual vertically arranged bins each with an inlet for receiving individual sheets from a sheet transport which conveys each sheet vertically to the bins in succession. Means are provided for moving the array in a vertical direction for the sequential disposition of a selected ones of the bins, or for all of the bins at a sheet receiving station for receiving at least the last sheet of the copy sets. A set transport means is also provided for removing each set of collected sheets from the bins at another fixed station immediately below the sheet receiving station, while the array is being moved vertically to receive the last sheet. Stapling means for binding each set after removal from the sorter array is arranged to receive each set from the set transport.

While the invention is disclosed in combination with a reproduction machine of the electrostatographic type, it will be understood that the disclosed collating system may be combined with other printing apparatus or machines which merely sort, collect and/or effect the movement of informational items such as sheets or cards.

Other objects and advantages will be apparent from the ensuing description and drawings wherein.

Figure 1:
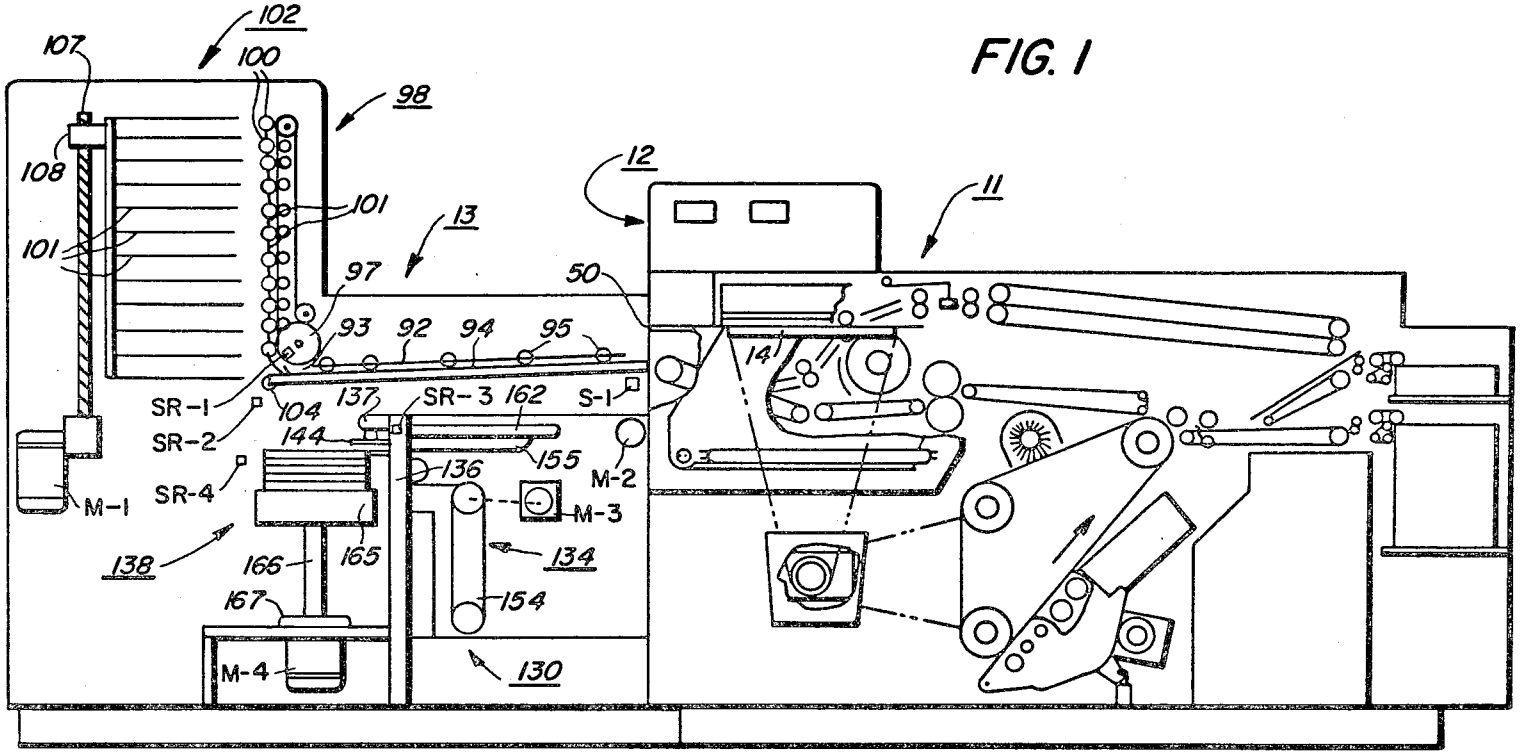
FIG. 1 is a schematic illustration of a configuration of an electrostatographic printing/finishing system employing the present invention.
Figure 4:
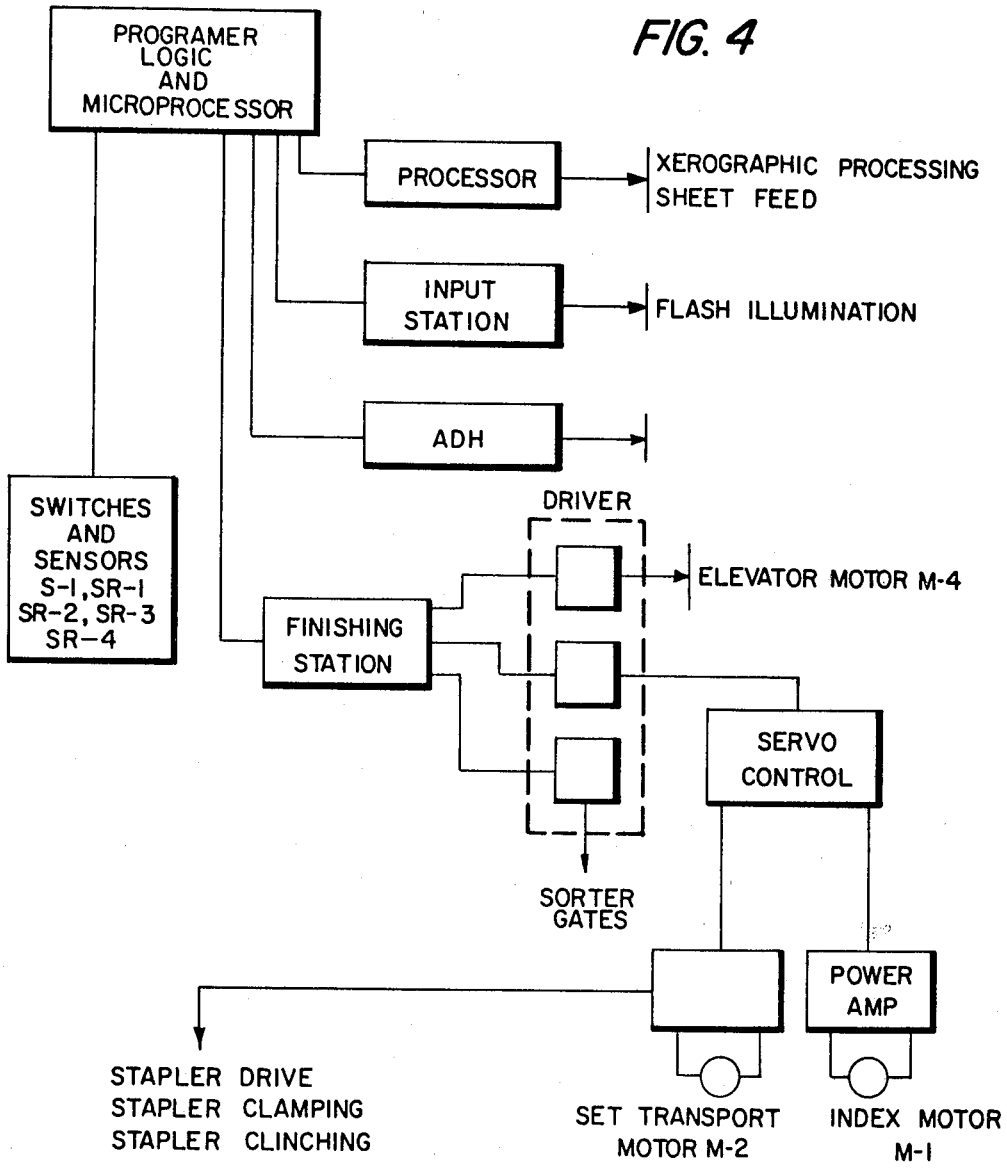

FIGS. 3(*a*) to (*d*) illustrate a sequence of events in the finishing of sets of copy sheets; and FIG. 4 is a block diagram of the control scheme for the printing system of FIG. 1.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and an automatic type document handling apparatus 12. Preferably, the processor 11 is the same as the processor in the commercial embodiment of the Xerox 9400 Duplicator, which utilizes flash, full frame exposure for very high speed production. Document sheet exposure, image processing and copy sheet transport/handling are under control by a machine programmer and are effected in timed sequence, and in accordance with the program an operator has preset in the machine. Further details in this regard are not necessary since the Xerox 9400 Duplicator operates in this manner and is well known. Details of the timing relationships, the programmer, and related structure and events are described in U.S. Pat. Nos. 3,790,270; 3,796,486; and 3,917,396, commonly assigned and which are incorporated by reference. It will be understood that most any other type of xerographic processor and document handling apparatus may be utilized. Operating in conjunction with the processor 11 and apparatus 12 is a finishing station 13 and thereby forms the reproduction system shown in FIG. 1.

The system comprising the processor 11, the document handling apparatus 12, and the finishing station 13, is under control of a programmer P which permits an operator various options: to turn the entire system ON or OFF; to program the reproduction system for a desired number of reproductions to be made of each original document sheet or set; to select whether simplex or duplex copies are to be made; to select a desired output arangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the microprocessor is one similar to the Intel 8080 Microprocessor manufactured by the Intel Corporation, Santa Clara, Calif., and having sufficient ROM's and RAM's for all of the necessary functions in the reproduction system.

The document handling apparatus 12 serves to feed one document sheet D at a time from a supply of document sheets into copying position on the platen 14 where a single exposure of only one copy set is programmed, or a plurality of exposures may be made. Following exposure one or more times, each document sheet is automatically returned to the document supply and the next document sheet, if any, is brought into the exposure position on plate 14. Document sheets returned to the supply stack may be recycled by the apparatus 12 or simply removed by the user when the copying program is completed. Since the particular document apparatus 12 is a commercial device being part of Xerox Corporation's product labeled the 9400 Duplicator, and a variation of the same is adequately described in U.S. Pat. No. 3,944,794, which is incorporated by reference herein, further description thereof will not be included herein.

Further details of the processing devices and stations in the printer system or processor are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein.

As previously described, the document apparatus 12 includes a document tray adapted for supporting a stack comprising a plurality of document sheets in numbered sequence with page one of the multi-page document on the bottom of the stack. Since the illustrated document handling apparatus is of the bottom feeder type, page one will be the first document sheet imaged, and so on.

For either the simplex or duplex modes of operation, copy sheets exiting the exit slot 50 positioned at one end of the housing for the xerographic processor 11 are directed to the finishing station 13 which comprises a sorting or collating mechanism, a stapler apparatus, and an output elevator system. After leaving the processor 11, each sheet is positioned upon a transport 92, is registered thereon and further conveyed generally along the same horizontal plane as its previous path to a fixed receiving point or station 93. The transport includes a movable endless transport belt 94 upon which each sheet is placed and a plurality of loosely retained rotatable balls 95 which rest along the belt 94 by gravity and which coact with the belt to convey sheets therebetween. The belt 94 is driven by a motor and suitable gearing and pulleys (not shown) at a speed slightly greater than the processing speed of the processor 11 in order to add more working space between the sheets and to ensure that the final handling of copy sheets does not impede the throughput of the entire system as determined by the process speed.

At the exit slot 50, a sheet-contacting switch S-1 is positioned to be actuated as each sheet enters the transport 92 of the finishing station 13. The circuit for this switch is connected to the logic in the programmer P and serves to reset the machine clock for the finishing function so that zero time for the sheet commences when the sheet is at the reference point 93.

Figure 2:
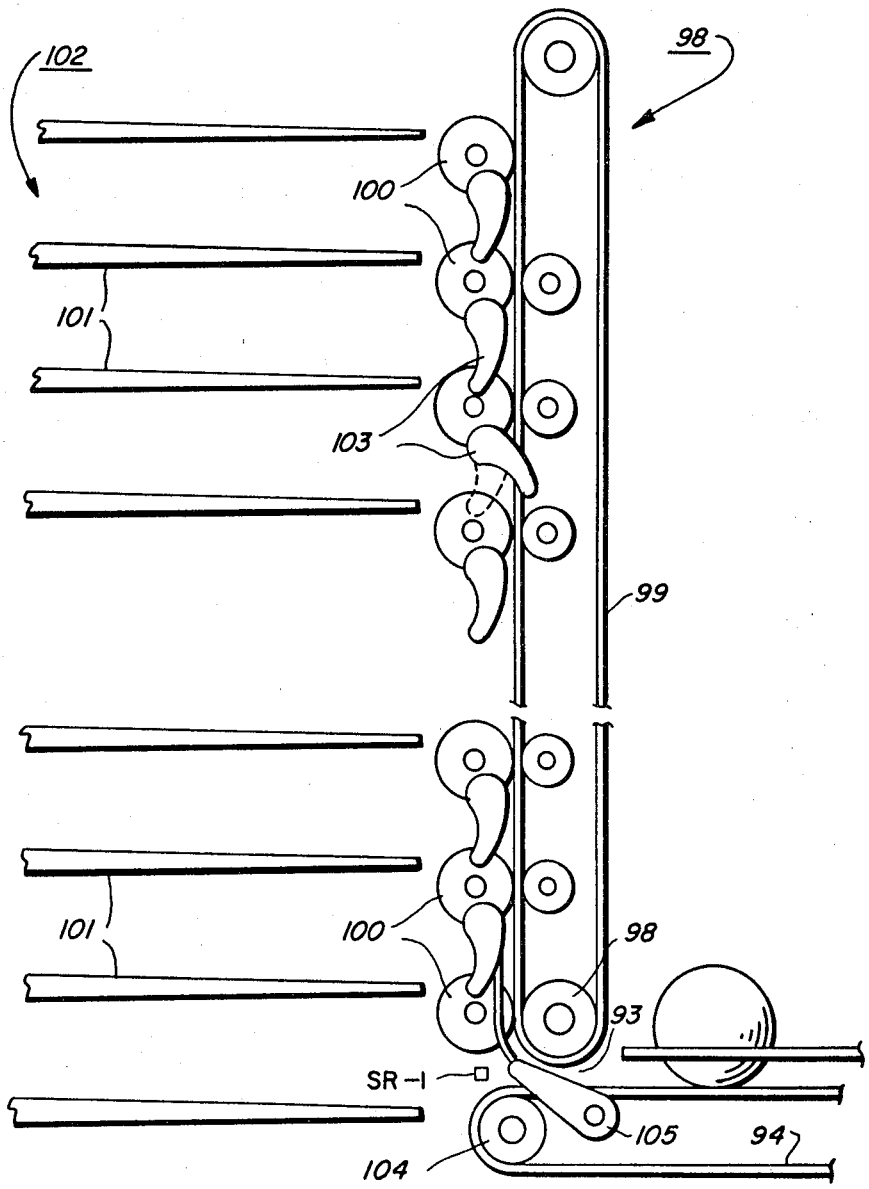
FIG. 2 is a cross-sectional view of the gated transport apparatus utilized with the present invention.
Figure 3A:
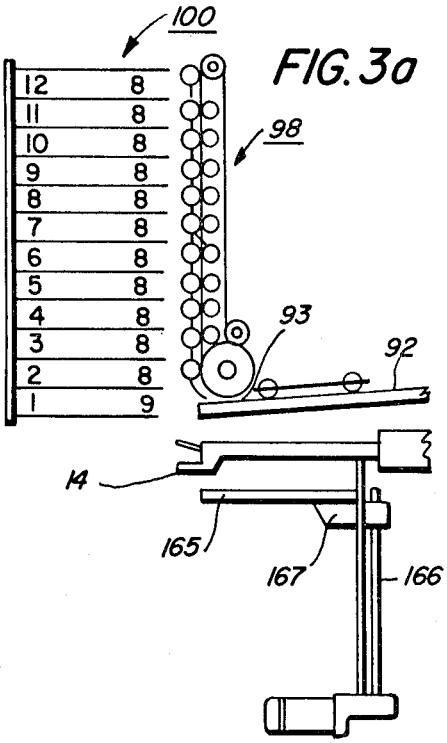
Figure 3B:
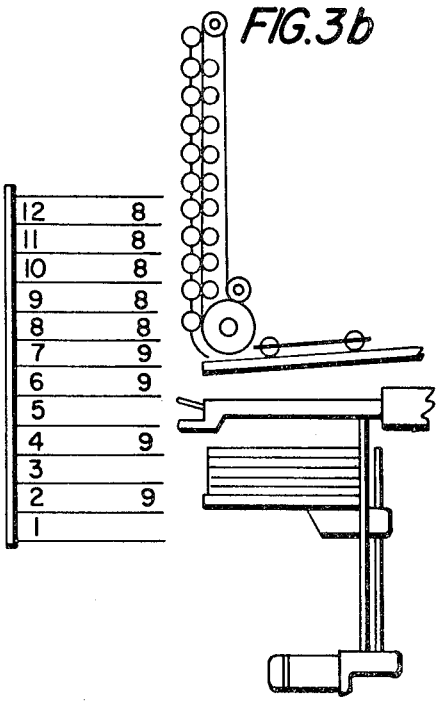
Figure 3C:
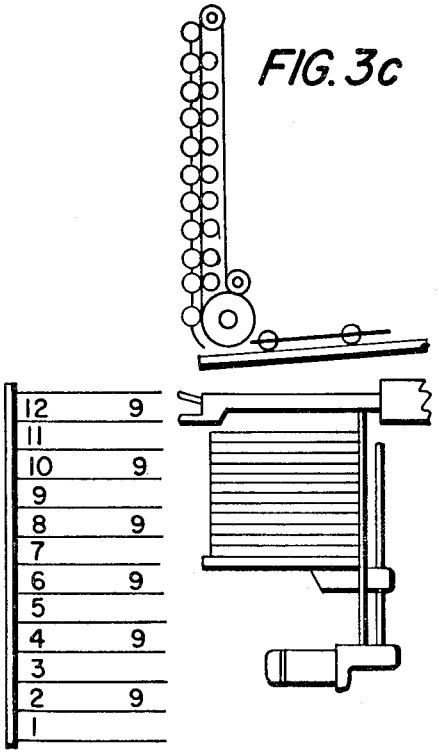
Figure 3D:
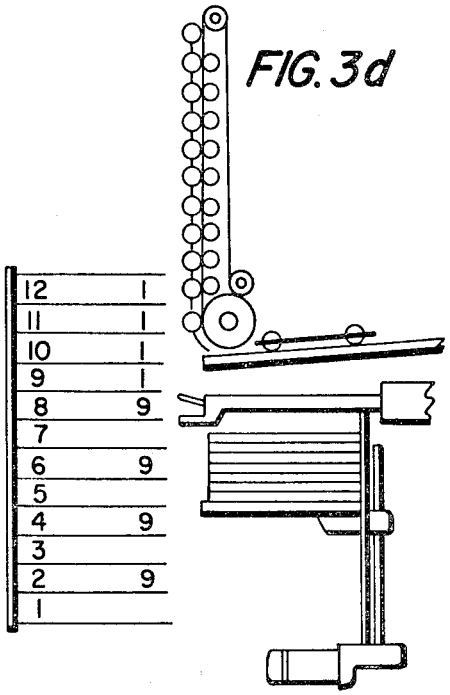

As shown in FIGS. 1 and 2, the station 93, a lower roller 97 of a vertical conveyor belt mechanism 98 of the gated transport type is positioned to receive copy sheets from the transport belt 94 and to apply them upon a belt 99 for the mechanism. The belt 99 cooperates with a plurality of rollers 100 for transporting copy sheets vertically past the open ends of an array of collecting bins 101 for a sorter generally indicated by the reference numeral 102. A gate 103 is associated with each of the bins 102 for directing a sheet into a bin 101 when a gate 103 has been pivoted to a position to deflect a sheet into the associated bin. A suitable solenoid (not shown) may be utilized with each of the gates for causing deflection thereof and the programmer P may include the control circuitry for effecting the timed sequence of their operation in accordance with a program selected by the operation.

In the illustrated embodiment, the array 102 includes twelve horizontally disposed bins 101 arranged in a vertical stack, the number of which corresponds to the predetermined number of exposures made of each document sheet while it is on the platen 14. The number of bins utilized should correspond to the total number of sheets in the paper path when the system has been programmed for the duplex mode so that a minimum of machine "pitches" are not skipped. The number of exposures made for each document sheet positioning on the platen also corresponds to this total number of sheets, which for the illustrated machine is twelve sheets.

The belt 99 may be driven by any suitable means in the direction indicated by an arrow in order to permit collation of copy sheets into the bins 101 as the gates 103 are sequentially actuated. The sequence of loading or collecting sheets starts with the bottommost bin and progresses to the topmost bin. Further details of a gated transport are unnecessary as these are known in the art and are provided in the sorter modules associated with the Xerox 9400 Duplicator. U.S. Pat. No. 3,709,492 discloses such transports, except the orientation which for the patented system is horizontal rather than vertical.

The array 102 is mounted for bi-directional vertical movement within a suitable supporting fixed frame and, as shown in FIG. 1, the array is positioned in its normal standby position with the lowermost bin opposite the roller 104 associated with the transport belt 94 adjacent the station 93. The lowermost gate 105 is at its deflection position, whereat the sheet will be directed upwardly between the rollers 100 and the belt 99. When the gate 105 is actuated out of this position and into its inactive position, the lowermost bin receives sheets directly from the conveyor belt 94, through the station 93.

For ease of understanding later description, the bins are numbered consecutively from 1 to 12 starting at the lowest bin with bin numbered 12 at the top of the array. The array is held stationary during collating of copy sheets for all but at least the last sheet of each set of copy sheets being collected, and is indexed in the downward direction past the receiving point 93 for the sequential receiving of the last copy sheet in each of the bins. Upon operating in this sets mode, the array indexes downwardly one bin at a time and as each bin becomes aligned at the station 93, movement of the last copy sheet into each bin 101 is achieved directly by the transport belt 94 since the gate 105 would have been programmed to its inactive position for this phase of the operation. A suitable sensor SR-1 may be positioned at the front edge of the lowermost bin to indicate to the system logic that this action has occurred and to enable another indexing operation. In addition, as the array indexes downwardly, a set transport, to be described hereinafter, unloads a set from the array at the rate of every other bin, say for example, the odd numbered bins. During return of the array to the normal position, the set transport unloads the even numbered bins thereby completing the unloading of the array.

When the array 103 reaches its lowermost position and bin numbered 12 has received its last copy sheet, the document handling apparatus 12 has already removed from the platen the document sheet which initiated the production of the last copy sheets, has added and copied a successive document sheet of a document set, and has fed still another document sheet to the platen. Since there are a number of images being processed in the processor 11, in our example, twelve sheets in the paper path being conveyed by the various transports, two document sheet changes would have occurred earlier than the time that the last copy sheet indicative thereof is received in bin 12. As the array indexes upward for the unloading of the remaining copy sheets, the first copy sheet of the next succeeding document sheet will be received in the bin numbered 12 whereupon the array will index upwardly now to permit reception of the copy sheets in each of the bins successively. During the upwardly indexing movement of the array 102, the first copy sheet entering each of the bins 101 will be made directly from the transport belt 94, as the gate 105 will still be programmed to its inactive position. When the array reaches its initial starting upper position, it will remain stationary as before and the gate 105 will be actuated to its deflection position. The array is now conditioned to receive each succeeding copy sheet until the last copy sheets of the copy sets are in a position to be received in the array, whereupon the array will be indexed downwardly as described above.

As will be described hereinafter, a set binding apparatus in the form of a dual stapler apparatus is arranged immediately below the bin receiving point 93. This apparatus includes means to remove completed sets of collated copy sheets from every other bin to effect single or dual stapling along an edge of the set if so programmed or no stapling at all, and to position the stapled or unstapled sets on an elevator mechanism. In order to permit complete removal of the sets from all of the bins 101 in the array 102, the array must index once downwardly relative to the point of set unloading and once upwardly. In the normal operating sets mode, the sorter/finishing arrangement handles twelve sets at a time (a block of 12 copy sets) in cooperation with the document handling apparatus 12 as the latter exposes each document sheet twelve consecutive times before advancing to the next document sheet until the complete set thereof has been exposed. If more than twelve copy sets have been programmed, the document apparatus/sorter finisher system will complete the reproduction run in blocks of 12 copy sets. The system will continue to sort and automatically unload in blocks of 12 sets until the programmed number of sets is completed.

The bin array 102 is indexed vertically in either direction by a drive screw 107 connected to the shaft of a servo motor M-1 which is mounted to the base of the frame for the machine. These movements of the array are effected by a ball 108 secured to the rear wall of the array and through which the screw 107 is threadedly related. Rotation of the screw (which is fixed against axial movement) in either direction will impart corresponding up or down movement of the ball 108 and consequently the array. Further details of the bin array structure is not necessary as these details are disclosed in the above referred to U.S. patent application. Any other drive apparatus may be utilized for indexing the array, such as pulleys and cables or suitably arranged fluid drive system.

After copy sheets, simplex or duplex, have been produced in the processor 11, transported by the transport 92 and collected in the bin array 102 while the system is in either the sets mode or the stacks mode, the collected sets are now in condition to be further processed by a finishing apparatus generally indicated by the reference number 130. Actually, as will be discussed below, during the last series of indexing movement of the bin array when it is moving to its uppermost position, copy sets removal for the finishing action may take place simultaneously with collection of copy sheets.

The finishing apparatus 130 comprises five subassemblies each of which is programmed to operate in timed sequence with each other, with the system logic and programmer P, to be timed relative to the number of sets and copy sheets per set which were previously pre-programmed by an operator, and with the document sheet actuation of the apparatus 12. As shown in FIG. 1, the finishing apparatus comprises a set transport 132, individually-operable, dual stapler apparatus 134, and a set kicker 136. In conjunction with the finishing apparatus 130, the finishing station 13 also includes an elevator 138 and sets/stacks conveyor 140. All of these five subassemblies are fully disclosed in the above referred to U.S. patent application and details therefor will not be described herein.

The set transport 132 is utilized to unload automatically sets or stacks of copy sheets from the bins at an unload station two copy-cycle pitches or bins below the sorter bin load station at 93. The set transport includes a reversible servo motor M-2 which effects reciprocable movement of the copy set clamping jaws 144, to the sorter 102 in a set gripping position, in the opposite direction to a set stapling position, and still further in that direction, to retract the jaws and back again to the sorter, all in cyclic actuation. In moving toward the sorter 102, the jaws 144 are sensed by a sensor SR-2 mounted on the frame for the sorter to zero reference the positioning of the set transport as a timing monitor of subsequent timed events in the finishing function. The clamping and unclamping action of the jaws 144 is provided by a suitable solenoid valve in a pneumatic device (not shown).

The kicker mechanism 136 is utilized to push or kick stapled sets from the stapler apparatus and permit dropping of the set onto the elevator 138. If a stacks or unstapled sets mode has been programmed, the kicker mechanism is arranged to serve as a backstop for the clamping jaws 144 to strip stacks against. Drive is imparted to the mechanism 138 by a motor M-3 which is a motor which can be utilized to drive the stapler heads as will be described hereinafter.

The stapler apparatus 134 provides a stapling function either with a single staple or with two staples, both being adapted to be applied at various positions along a long edge of a set or stack of copy sheets. Stapling is achieved by way of two identical mechanisms, each of which provides the function of set clamping, staple driving, and staple clinching. Preferably, the apparatus utilizes two commercial type stapler heads 155, such as the Bostitch staple head indicated as the 62-E manufactured by the Bostitch Division of Textron Corporation of Providence, R.I.

A sensor SR-3 is positioned adjacent and between the stapler heads and is utilized in conjunction with the sensor SR-2 to monitor the time between the zero reference of the jaws 144 as they move toward a sorter bin and the time an edge of a set of copy sheets reaches the stapler heads to be stapled. This timing data is transmitted to the microprocessor in the programmer P.

The elevator 138 is utilized to collect into a pile the stapled or unstapled sets or stacks of copy sheets for delivery to the operator. The elevator comprises a tray assembly 165 mounted at the upper end of a vertically arranged, drive screw 166 threadedly received in a threaded member 167 vertically fixed to the base frame for the finisher so that upon rotation of the member 166, the tray 165 is moved vertically in the up or down direction. A reversible motor M-4 is operatively connected to the member 167 for imparting rotation to the same in either direction. The tray receives the stapled or unstapled or stacks as they are dropped when acted upon by the kicker mechanism 136.

Elevator height of piled sets or stacks is controlled by an optical sensor SR-4 which "looks" across the stack and effects the energization of the motor M-4 and lowering of the tray 165 until the pile is below the sensor. A second sensor (not shown) may be positioned to sense the lowermost position of the elevator tray 165 whereat the tray is considered at full capacity.

In FIGS. 3 (*a*)–(*d*), there is shown sequences of collating and finishing events for a document having nine document sheets. In these illustrations, the vertical column of numbers 1–12 at the left of each sequence indicate the bin number and the right hand vertical column of numbers indicate the copy of the document sheet being collected. As previously stated, it is assumed that the document handling apparatus 12 is programmed to place a document sheet upon the platen 14 and to effect twelve exposures of the sheet before the removal of the document sheet and placement of a succeeding document sheet, and so on. This assumption also corresponds with the number of bins in the array 102 wherein each copy sheet produced during the exposure of a document sheet on twelve occurrences is received in a bin.

In FIG. 3(*a*), each of the bins 2–12 contain eight copy sheets, all having been conveyed therein by the transport mechanism 98, while bin 1 contains all nine sheets, the ninth sheet having been conveyed into bin 1 directly by the transport 92 through the station 93. The logic in the programmer P is arranged to convey the last sheets of the copy sets in this manner as the array 102 indexes downwardly. The sensor S-1 in cooperation with the programmer clock and the operator preset reproduction run program will determine when the last sheets are to arrive and to effect initiation of the downward indexing activity. The bin array 102 in indexing from its upper position to its lower position, will receive the ninth copy sheet of the last document sheet in the bins numbered 2–12 consecutively. In this example, it will be assumed that there are nine document sheets in the document being processed in the document handling apparatus 12. Since the ninth copy sheet is the last sheet in the sets being produced, as the array 102 indexes downwardly, as shown in FIG. 3 (*b*) to receive each last sheet, the sets, now complete, in the odd numbered bins will also be acted upon by the finishing function comprising the set transport mechanism 132, the stapler apparatus 134 and the set kicker mechanism 136, as aforesaid. It wil be noted that for the finishing function, every other bin is affected during the downward movement of the array, while every successive bin receives the ninth copy sheet. Since the convention in the described example is such that a copy sheet is produced every one-half second, clamped sets are delivered to the stapler at one second intervals.

In FIG. 3(*c*), on the upwardly return indexing movement of the array, the remaining sets in the even numbered bins are removed and finished. In the event more than twelve copy sets of the nine sheet document has been programmed, the upwardly indexing array, in going from its position in FIG. 3(*c*) to the positioning in FIG. 3(*d*), will receive the first copy sheets for the first document sheet being processed in the apparatus 12 as the latter commences its recycling sequences. This process continues, with the document being copied in multiples of twelve sets until the copy/finishing run has been completed or terminated.

FIG. 4 is a block diagram of a control arrangement for the reproduction system in FIG. 1. The programmer P is operatively connected to four remotes: (1) the processor 11 for controlling the xerographic processing, copy sheet movement, timing and monitoring and all other parameters in the processor; (2) the input station comprising the flash illumination system circuitry; (3) the automatic document handling apparatus 12; and (4) the finishing station 13.

The finishing station 13 includes three drivers, one of which is operatively connected by way of relays or reediac to the elevator motor M-4. Another driver is operatively connected to a servo controller which in turn is connected to two power amplifiers and asociated circuitry. The third driver is operatively connected to the sorter gates 100 by way of their actuating solenoids (not shown). One of the power amplifiers serves to energize and operate the sorter array index motor M-1, while the other amplifier serves to energize and operate the set transport motor M-2. One of the power amplifiers also is operatively connected to the stapler drive system, the stapler clamping system, and the stapler clinching system.

From the foregoing it will be apparent that an electrostatographic system with finishing station has been described which will produce stapled collated sets and unstapled sets or stacks at a high production rate without loss of throughput, at a rate in accordance with the full processing speed of the copy processing machine and with a minimum of wear and fatigue of the moving parts.

While the invention has been described with reference to the structure disclosed, it is not confined to the details set forth but is intended to cover such modifications or changes as may come within the scope of the following claims.

I claim:

1. In a reproduction system having a processor for reproduction information to be copied on copy sheets in either simplex or duplex modes of operation and means for producing the information in the form of an individual light image for one or both sides of a copy sheet, each light image being produced a predetermined number of times in succession before a different succeeding light image is produced the same predetermined number of times, thereby effecting the production of copy sheets of the same predetermined number at any one time, the improvement including:

an array of sheet collecting bins arranged to receive copy sheets and to collate the same into sets of copies of different images, means for transporting a plurality of the copy sheets from said predetermined number to said collecting bins at the rate of one sheet per bin while said array is held in a fixed position, means for producing movement of said array of bins from said fixed position, and means for transporting at least one of the copy sheets from said predetermined number to said collecting bins while said array has been moved from said fixed position.

2. The reproduction system of claim 1 including a set binding apparatus, and means for activating the same for binding collated sets when said array of bins is being indexed.

3. In a reproduction system having a document handling apparatus adapted to transport individual document sheets of a multiple page document from a supply stack to an exposure platen of a reproduction processor and effecting multiple exposure of at least one side of each of the document sheets before returning the sheet to the supply stack, wherein the processor produces copy sheets of the exposed document sheets, the combination of:

a sorter array having a plurality of bins, means for transporting the copy sheets of a plurality of at least one side of each of the document sheets from the processor to each of said bins sequentially for collating said sheets into copy sets correspond to the document, while said array is held in a fixed position, a finishing apparatus adapted to receive collated sets of copy sheets of a set of document sheets when activated and to bind the same, and means for producing indexing movement of said array of bins simultaneously with the activation of said finishing apparatus.

4. In combination with a reproduction system having a processor adapted to produce a plurality of copy sheets of different informational areas thereon, the improvement including:

a sorter having a plurality of bins arranged to receive the copy sheet output from the processor and to collate the same into copy sets, means for moving said sorter between a fixed position and a plurality of indexed positions, and control means for directing a plurality of copy sheets into said bins when said sorter is in said fixed position and to direct at least one of the copy sheets in each of the sets when said sorter is moved to each of said index positions.

5. In a reproduction system having a processor for reproducing information to be copied on copy sheets and means for producing the information in the form of an individual light image for each copy sheet, each light image being produced a predetermined number of times in succession before a different succeeding light image is produced the same predetermined number of times, the improvement including:

an array of sheet collecting bins arranged to receive copy sheets and to collate the same into sets of copies of different images, means for transporting some of the copy sheets output of the processor to said collecting bins at the rate of one sheet per bin while said array is held in a fixed position, means for producing indexing movement of said array of bins from said fixed position, means for transporting at least one of the copy sheets output of the processor to said collecting bins while said array is being moved, and a set binding apparatus, and means for activating the same for binding collated sets when said array of bins is being indexed.

6. In a reproduction system having a processor for reproducing information to be copied on copy sheets as either simplex or duplex copies and means for producing the information in the form of an individual light image for a side of a copy sheet, each such light image being produced a predetermined number of times in succession before a different succeeding light image is produced the same predetermined number of times, the improvement including:

a sorter having a number of sheet collecting bins equal to said predetermined number arranged to receive copy sheets and to collate the same into sets of copies of different images, means for transporting a plurality of the copy sheets produced from said predetermined number of times a light image is produced to said collecting bins at the rate of one sheet per bin while said sorter is held in a fixed position, means for producing movement of said sorter from said fixed position, and means for transporting at least one of the copy sheets produced from said predetermined number of light images produced to said collecting bins while said sorter is being moved.

7. In a reproduction system having a processor and control system therefor for producing in succession a predetermined number of copy sheets at a time of information to be copied before succeeding information to be copied is produced, the improvement including an array of sheet collecting bins arranged to receive and collate the predetermined number of copy sheets of each succeeding information being copied, drive means for producing movement of said array of bins, and control means operatively connected to said drive means for holding said array in a fixed position while receiving a plurality of said predetermined number of copy sheets and for moving said array to a position other than said fixed position to receive at least one of the copy sheets of said predetermined number.

8. A sorting system for receiving and collating copy sheets comprising an array of sheet collecting bins, a sheet transport means for conveying sheets to said array and having a sheet receiving station at which sheets are conveyed to said array, drive means for moving said array from a first position to a second position in indexing movement to index each bin adjacent said receiving station, means for transporting a plurality of copy sheets to said array while the same is maintained in said first position, and control means operatively connected to said drive means for effecting said indexing movement of said array from said first position to place one or more bins adjacent said receiving station for receiving at least one copy sheet.

9. In a method of producing copy sheets representative of pages of a document set to be copied and collecting the copy sheets into collated copy sets utilizing a copy sheet processor and control system therefor, the steps of:

1. producing in succession a plurality of copy sheets having a predetermined number each of the document pages, and
2. collating the copy sheets into an array of bins in the following manner,
   (a) holding said array in a stationary position while collating said plurality of the copy sheets for each of the document pages,
   (b) moving said array away from said stationary position and directing each bin adjacent a sheet receiving position,
   (c) transporting at least one copy sheet of each copy set into a bin as the same is moved adjacent to said receiving position.

10. In a method of producing copy sheets representative of pages of a document set to be copied and fastening the copy sheets into collated copy sets utilizing a copy sheet processor and control system therefor, the steps of 1. producing in succession a plurality of copy sheets having a predetermined number each of the document pages,
2. collating the copy sheets into an array of bins in the following manner,
   (a) holding said array in a stationary position while collating said plurality of the copy sheets for each of the document pages,
   (b) moving said array away from said stationary position and directing each bin adjacent a sheet receiving position,
   (c) transporting at least one copy sheet of each copy set into a bin as the same is moved adjacent to said receiving position, and
3. fastening each collated copy after said at least one copy sheet has been transported into a bin.

* * * * *